United States Patent [19]

Rausch et al.

[11] Patent Number: 4,637,838

[45] Date of Patent: Jan. 20, 1987

[54] PROCESS FOR PHOSPHATING METALS

[75] Inventors: Werner Rausch, Oberursel; Gerhard Mueller, Hanau am Main, both of Fed. Rep. of Germany

[73] Assignee: Metallgesellschaft, A.G., Frankfurt, Fed. Rep. of Germany

[21] Appl. No.: 708,463

[22] Filed: Mar. 5, 1985

[30] Foreign Application Priority Data

Mar. 9, 1984 [DE] Fed. Rep. of Germany ..... 3408577

[51] Int. Cl.[4] ..... C23F 7/10

[52] U.S. Cl. ..... 148/6.15 Z

[58] Field of Search ..... 148/6.15 Z

[56] References Cited

U.S. PATENT DOCUMENTS 2,743,204 4/1956 Russel ..... 148/6.15 Z

FOREIGN PATENT DOCUMENTS 0800240 1/1981 U.S.S.R. ..... 148/6.15 Z

*Primary Examiner*—Sam Silverberg

*Attorney, Agent, or Firm*—Arthur E. Kluegel

[57] ABSTRACT

The quality of coatings in a low zinc phosphating process is improved by including an activator of formate, nitrilotriacetate, trichloroacetate or ethylenediamenetetraacetate to produce more uniform coatings particularly desirable in advance of electrocoating.

6 Claims, No Drawings

PROCESS FOR PHOSPHATING METALS

BACKGROUND OF THE INVENTION

The present invention relates to a process for phosphating metals, in particular steel and galvanized steel, by a spray method, using an aqueous acidic phosphating solution containing an accelerator, zinc and, if appropriate, nickel, and the use of this process prior to electrocoating.

German Offenlegungsschrift No. 2,232,067 describes aqueous acidic phosphating solutions, having a weight ratio of $Zn:PO_4$ of 1:(12 to 110) for the surface treatment of metals, in particular iron and steel. The zinc content, which is lower than that of the conventional phosphating baths, leads to improved thin, uniform phosphate coatings which are very firmly bonded and resistant, and particularly suitable as a basis for subsequent electrocoating.

PCT publication No. WO 84/00386 discloses phosphating solutions which contain 0.2 to 0.6 g/l of Zn and Ni in a ratio of 5.2 to 16 moles of Ni per mole of Zn, and which give phosphate layers which are particularly resistant to dissolution in alkali.

Japanese Patent Publication (according to Chemical Abstracts 99/216843 u) No. 58 144 477 describes spray phosphating solutions for steel which contain 0.1 to 0.5 g/l of Zn, 15 to 30 g/l of phosphate and 0.01 to 0.2 g/l of nitrite. The phosphate layers thus produced are particularly suitable as the pretreatment for a subsequent cathodic electrocoating. Other prior publications include U.S. Ser. No. 373,475, now U.S. Pat. No. 4,419,199 which discloses activators for certain zinc phosphate solutions.

The disadvantages of the conventional processes with zinc concentrations of 0.1 to 0.6 g/l in the phosphating bath is that, when used for spraying on steel, they frequently lead to phosphate layers which are not level, and which are partly gray and partly have a greenish blue iridescent color. This unevenness may be evident in the subsequently applied electrocoating paint and may necessitate expensive after-treatment. Furthermore, the adhesion of the surface coating under load, for example as a result of bending or prolonged contact with water, does not always meet the requirements set.

It is the object of the invention to provide a process which does not have the disadvantages of the conventional processes and gives level, homogeneous phosphate layers with improved adhesion to surface coatings.

SUMMARY OF THE INVENTION

The object is achieved if the process of the type stated at the outset is carried out, in accordance with the invention, so that the metal surfaces are brought into contact with an aqueous acidic phosphating solution which contains 0.2 to 0.5 g/l of $Zn^{++}$
0 to 1 g/l of $Ni^{++}$
8 to 20 g/l of $P_2O_5$
0.5 to 0.2 g/l of $NO_2^3$ and/or
0.1 to 1 g/l of nitrobenzenesulfonate and at least one activator from the group comprising formate, nitrilotriacetate, trichloroacetate and ethylenediaminetetraacetate.

DETAILED DESCRIPTION OF THE INVENTION

The process according to the invention is intended in particular for the treatment of iron, steel and galvanized steel. However, it is also suitable for the phosphating of zinc alloys, aluminum and aluminum alloys.

The treatment is carried out by the spray method, the contact times for iron, steel and aluminum being, for example, 90 to 240 sec., and the contact times for zinc being, for example, 5 to 240 sec.

The phosphating solutions according to the invention are generally employed at bath temperatures between 30° and 60° C.

The addition of nickel to the phosphating bath has, as a rule, an advantageous effect on the phosphating rate, the layer formation on steel surfaces which are more difficult to phosphate, the phosphating of zinc surfaces and the anticorrosive properties.

To establish the equilibrium in the phosphating process, the phosphating solutions to be employed in the process according to the invention preferably contain alkali metal ions, for example Na, K, Li, or $NH_4$, and, if required, further anions, for example $N_3$, Cl or $SO_4$. The baths may furthermore contain other cations conventionally used in phosphating technology, such as Co, Cu, Mn, Ca, Mg and Fe.

Nitrite and/or nitrobenzenesulfonate are used as oxidation accelerators in the process according to the invention. The concomitant use of further oxidation accelerators, for example chlorate, is possible and may be advantageous.

The activators to be employed in the process according to the invention have an accelerating and leveling action on layer formation and control the weight per unit area of the phosphate layers. They can be added, for example, in the form of the corresponding acids or as alkali metal salts. The individual activators are preferably present in the phosphating solution in the following concentrations: 5 to 15 g/l for formate; 0.3 to 3 g/l for nitrilotriacetate; 2 to 15 g/l for trichloroacetate; and 0.1 to 3 g/l for ethylenediaminetetraacetate. In addition to the foregoing, other additives/activators which may be included are 0.5 to 3 g/l fluoride; 1 to 5 g/l hexafluorosilicate; 3 to 10 g/l tetrafluoroborate; 0.3 to 5 g/l glycolate; 0.01 to 0.5 g/l citrate; 0.03 to 0.8 g/l tartrate; and 0.03 to 0.3 g/l condensed phosphate, such as pyrophosphate, tripolyphosphate and hexametaphosphate.

The weight per unit area of the phosphate layers produced on steel by the process according to the invention is in general between 0.8 and 2.5 $g/m^2$. In order further to promote the formation of particularly thin finely crystalline phosphate layers, it is advisable to use conventional activators, for example those based on titanium phosphate, in the pre-rinsing bath or in the final cleaning stage.

The phosphate layers produced using the process according to the invention are suitable in principle for all purposes where phosphate layers can be used. In conjunction with a surface coating, the layers result in an unusually pronounced improvement in the resistance of the surface coating film to underpenetration when subjected to corrosive stress, and a substantial increase in the adhesion of the surface coating to the metallic substrate when subjected to stress through scratching, impact and bending. These advantages are evident, particularly for electrocoating, in particular for cathodic electrocoating; for this reason, the process is preferably used as a preparation for this method of coating. The process according to the invention is used in practice, for example, for the phosphating of automotive bodywork.

The examples which follow illustrate the process according to the invention in more detail and by way of example.

EXAMPLES

Body sheet steel sections degreased with mildly alkaline, activating cleaner by the spray method and then rinsed with water were treated by being sprayed with the phosphating solutions below for 2 minutes at 55° C., and then rinsed with water, rinsed with dilute Cr(VI)/Cr(III) solution to passivate them, sprayed off with deionized water and partly dried and partly provided with a cathodic electrocoating. The phosphating solutions according to comparative Examples 1 to 7 each contained 0.5 g/l of Ni
14 g/l of $P_2O_5$
1.5 g/l of $ClO_3$ and
0.1 g/l of $NO_2$,
and the zinc contents stated in the table.

The phosphating solutions according to Examples 8 to 11 contained 0.4 g/l of Zn
0.5 g/l of Ni
14.0 g/l of $P_2O_5$
1.5 g/l of $ClO_3$ and
0.1 g/l of $NO_2$
and, in addition, the activator contents mentioned in the table. This stated phosphating solutions were each brought to the phosphating equilibrium with alkali.

The results of the phosphating treatment are summarized below in the form of an assessment of the layer.

TABLE 1

| Phosphating Solution | | Assessment of the Layer |
|---|---|---|
| 1 | 0.1 g/l of Zn | Iridescent blue |
| 2 | 0.2 g/l of Zn | About 80% iridescent blue<br>About 20% gray and finely crystalline |
| 3 | 0.3 g/l of Zn | About 60% iridescent blue<br>About 40% gray and finely crystalline |
| 4 | 0.4 g/l of Zn | About 30% iridescent blue<br>About 70% gray and finely crystalline |
| 5 | 0.5 g/l of Zn | About 20% iridescent blue<br>About 80% gray and finely crystalline |
| 6 | 0.6 g/l of Zn | About 5% iridescent blue<br>About 95% gray and finely crystalline |
| 7 | 0.7 g/l of Zn | Gray and finely crystalline |
| 8 | 7 g/l of formate | Gray and finely crystalline |
| 9 | 1 g/l of nitrilotriacetate | Gray and finely crystalline |
| 10 | 10 g/l of trichloroacetate | Gray and finely crystalline |
| 11 | 0.3 g/l of ethylenediaminetetraacetate | Gray and finely crystalline |

The assessment of the layer clearly shows in Examples 8 to 11 the advantages of the procedure according to the invention compared with Examples 1 to 6 according to the prior art. Because steel sheets from different rolling mill batches exhibit different chemical surface activity, the absolute value of the visual assessment is subject to certain fluctuations, although this does not significantly affect the relative differences.

Similar assessments of the layer were also obtained for nitrite-containing chlorate-free phosphating solutions and for those containing nitrobenzenesulfonate, if appropriate together with nitrite.

After cathodic electrocoating, the steel sheets phosphated according to Examples 1 to 6 gave a surface coating film having an uneven surface structure, whereas level surface coating films could be deposited on the steel sheets phosphated according to Examples 7 to 11.

Some of the cathodically coated sheets were provided with an automotive finish built up to a total thickness of about 100 μm, and were tested by various methods. The results for the steel sheets treated according to the invention, in respect of VW road chippings impact with a salt spray test, crosshatch test after exposure to a damp heat atmosphere and bending over a conical mandrel, are very good and are substantially better than those obtained for Examples 4 and 7 of the prior art.

What is claimed is:

1. A process for phosphating metals, in particular steel and galvanized steel, by a spray method using an aqueous acidic phosphating solution containing an accelerator, zinc, wherein the metal surface is brought into contact with a phosphating solution which contains 0.2 to 0.5 g/l of $Zn^{++}$
8 to 20 g/l of $P_2O_5$
at least one accelerator selected from the group consisting of:
0.5 to 0.2 g/l of $NO_2$ and
0.1 to 1 g/l of nitrobenzenesulfonate
and at least one activator from the group consisting formate, nitrilotriacetate, trichloroacetate and ethylenediaminetetraacetate whereby a uniform coating in the range of 0.8 to 2.5 g/m$^2$ is obtained.

2. The process of claim 1, wherein the metal surface is brought into contact with a phosphating solution which contains at least one further additive from the group consisting of fluoride, hexafluorosilicate, tetrafluoroborate, glycolate, citrate, tartrate and condensed phosphate.

3. The process of claim 1, wherein the metal surface is brought into contact with a phosphating solution wherein the at least one activator is present in an amount of 5 to 15 g/l for formate
0.3 to 3 g/l for nitrilotriacetate
2 to 15 g/l for trichloroacetate
0.1 to 3 g/l for ethylenediaminetetraacetate.

4. The process of claim 2 containing at least one additive selected from the group consisting of:

0.5 to 3 g/l for fluoride
1 to 5 g/l for hexafluorosilicate
3 to 10 g/l for tetrafluoroborate
0.3 to 5 g/l for glycolate
0.01 to 0.5 g/l for citrate
0.03 to 0.8 g/l for tartrate and
0.03 to 0.3 g/l for condensed phosphate.

5. The process of claim 1 wherein the phosphated surface is subsequently subjected to electrocoating.

6. The process of claim 1 wherein the phosphated solution additionally contains up to 1 g/l of nickel ion.

* * * * *

UNITED STATES PATENT AND TRADEMARK OFFICE

CERTIFICATE OF CORRECTION

PATENT NO. : 4,637,838

DATED : January 20, 1987

INVENTOR(S) : Werner Rausch; Gerhard Mueller

It is certified that error appears in the above-identified patent and that said Letters Patent are hereby corrected as shown below:

In column 1, line 64, please delete "$NO_2^3$" and insert --$NO_2^-$--

In column 2, line 24, please delete "$N_3$" and insert --$NO_3$--

In column 4, line 33, please delete "0.5" and insert --0.05--

In column 4, line 36, please add the word --of-- before formate.

In column 4, line 65, please delete "phosphated" and insert --phosphating--.

Signed and Sealed this

Thirty-first Day of March, 1987

*Attest:*

*Attesting Officer*

DONALD J. QUIGG

*Commissioner of Patents and Trademarks*